United States Patent [19]

Patton et al.

[11] 4,222,318

[45] Sep. 16, 1980

[54] COMBINATION WINDOW AND FLOOR FAN

[75] Inventors: Noel T. Patton; Bennie N. Patton; Frank M. O'Donnell, all of Fort Wayne, Ind.

[73] Assignee: Patton Electric Co., Inc., New Haven, Ind.

[21] Appl. No.: 968,121

[22] Filed: Dec. 11, 1978

[51] Int. Cl.[3] ..... E06B 7/02

[52] U.S. Cl. ..... 98/94 R; 248/126; 248/245; 416/247 R

[58] Field of Search ..... 416/247 R; 98/88 R, 98/98, 99 R, 94 R, 94 AC; 248/126, 245

[56] References Cited

U.S. PATENT DOCUMENTS

| | | | |
|---|---|---|---|
| 1,549,440 | 8/1925 | Breidert | 98/94 R |
| 2,021,521 | 11/1935 | Sargent | 261/15 |
| 2,529,040 | 11/1950 | Morrison | 98/94 R |
| 2,620,127 | 12/1952 | Radcliffe | 98/94 R |
| 2,628,020 | 2/1953 | Koch | 98/94 R |
| 2,733,002 | 1/1956 | Huck . | |
| 2,830,779 | 4/1958 | Wentling | 248/126 |
| 2,857,095 | 10/1958 | Suarez Grau | 98/94 R |

OTHER PUBLICATIONS

Patton Brochure: The Hottest Thing in Cooling, 1977.

*Primary Examiner*—Ronald C. Capossela
*Attorney, Agent, or Firm*—Albert L. Jeffers; John F. Hoffman

[57] ABSTRACT

The present invention relates to a fan unit which may be used either as a floor fan or as a window mounted fan. When used as a floor fan, the frame is supported on the floor and the motor driven fan unit, which is pivotally connected to the frame, may be rotated to provide air flow in any direction. The fan unit comprises an open frame having a motor driven fan connected to the rear portion thereof, a pair of protruding pins on the frame front portion which engage the window on the outside thereof, and a second pair of protruding pins on the frame front portion which engage the window frame on the inside thereof. The motor driven fan is suspended in this manner inwardly away from the window opening such that the cantilever effect produced thereby pulls the first pins inwardly against the window and pushes the second pins outwardly against the window frame. The frame of the fan diverges slightly in the vertical direction so that it is, in effect, wedged into the window opening and makes it more difficult to remove accidentally and strengthens the frame. The unit is easily adapted for use with a horizontally sliding window by attaching a pair of removable laterally extending brackets.

32 Claims, 10 Drawing Figures

COMBINATION WINDOW AND FLOOR FAN

BACKGROUND OF THE INVENTION

The present invention relates to a combination floor fan and window fan, and in particular to means for conveniently and simply mounting the fan unit in a window opening.

There has long been a need for a multidirectional household fan which is versatile enough to be used both as a window-mounted fan and as a floor fan. One type of well known prior art fan comprises a rectangular frame which can be supported either on the floor, when it is utilized to recirculate air within a room, or on a windowsill, when it is used as an intake or exhaust fan. One problem with this type of fan, however, is that many windows do not have sills which are sufficiently large to accommodate the fan so that special brackets or a shelf must be mounted to the window frame to provide the necessary support. A further disadvantage is that the fan customarily sets completely within the window opening so that the only air which is exhausted by it, in the exhaust mode, comes from behind. As is known, this is quite inefficient in terms of the volume of airflow per unit time in comparison to havng the unit set back from the window where air can be drawn into the sides of the airstream produced by the fan.

In some window fans of this type, a reversible electric motor is provided so that the fan can operate in the intake as well as the exhaust mode. Due to the fact that the fan blades do not operate efficiently in the reverse direction, however, this is unsatisfactory. Manual reversal of the fan in the window is inconvenient because the fan must be completely removed from the window.

Another type of prior art fan, such as that disclosed in U.S. Pat. No. 2,857,095, comprises a tubular open frame wherein the motor driven fan is pivotally connected thereto for rotation about a horizontal axis. Although this fan functions well as a floor fan, special brackets are required to enable its being mounted to the window opening. This substantially reduces the versatility of the fan because it can be mounted only in those windows which have been provided with special mounting brackets.

SUMMARY OF THE INVENTION

The present invention overcomes the problems and disadvantages of the prior art by providing a fan unit which is capable of being used both as a floor fan and as a window fan, and which may be securely mounted within virtually any window opening such as an attic opening without the necessity for special mounting brackets, sill extensions, or the like. Furthermore, when mounted within a window opening in the exhaust mode, the motor driven fan is spaced inwardly from the opening so that air may be drawn into the airstream laterally between the fan blades and the window opening. As is known, this substantially increases the volume of airflow exhausted by the fan.

The constructional features of the fan which enable it to be so mounted within a window opening are the provision of a protruding element or elements, such as pins, blocks, hooks, ridges, plates or the like, on the forward portion of the fan frame. The upper portion of the frame extends through the window opening and the upper protruding element or elements hook around the means defining the window opening, whether it be the upper window in the case of a vertical sash-type window, the window and frame in the case of horizontal sliding windows, or the perimeter of any type of opening in a wall. The lower protruding elements abut against the windowsill in the case of vertical sash-type windows, and abut or are received within one of the horizontal tracks in the case of horizontal sliding windows. Because the motor driven fan is suspended inwardly from the window, the cantilever effect produced by this arrangement pulls the upper protruding elements inwardly and pushes the lower protruding elements outwardly thereby locking the fan in place, and also exerting a force laterally against the movable part of the window tending to make it bind so that it is less likely to move accidentally. In a preferred form of the invention, the frame is constructed so that it diverges vertically in the forward direction. This causes the frame to be wedged in the window opening in the case of vertical sash-type windows and is even less likely to be dislodged from the window opening if it should be jolted accidentally.

The primary advantages of the present invention are that it enables a very simply constructed multidirectional fan to serve both as a floor fan and as a window fan, and to be easily mounted in and be spaced back from virtually every type of window without the necessity for auxiliary mounting hardware, and also be readily removable.

Specifically, the present invention contemplates a portable fan unit comprising a frame having a front portion and a rear portion separated by side means connected to and extending between the front and rear portions, motor driven fan means for producing a stream of moving air mounted to the frame and spaced rearwardly of the front portion, the side means of the frame being constructed so as to permit airflow therethrough into the stream of air in directions transverse to the stream of air. Means are provided on the front portion of the frame for suspending the frame from the window opening such that the motor driven fan is spaced from the opening whereby air may be drawn into the airstream through the side means between the fan blades and the window opening. The means for suspending comprises means on the frame front portion adapted for extending into the window opening and hooking around the means defining the window opening.

DETAILED DESCRIPTION

Figure 1:
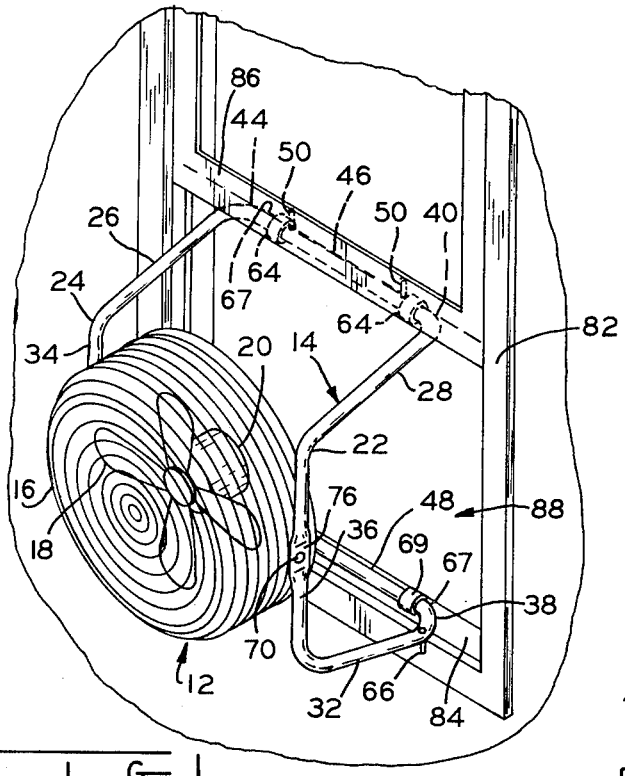
FIG. 1 is a perspective view showing the fan unit according to the present invention mounted within a vertical sash-type window.

Referring now to the drawings in detail, the fan unit 12 according to the present invention is illustrated and comprises a generally U-shaped frame 14 to which blade guard 16, which is generally fabricated of wires that are welded together, is pivotally secured. The fan blades 18 are driven by electric motor 20, the latter being provided with electric wires (not shown) for connection to a suitable source of electric current.

Frame 14 includes a pair of bent tubular members 22 and 24 comprising upper legs 26 and 28 and lower legs 30 and 32, which are connected to their respective upper legs 26 and 28 by means of intermediate legs 34 and 36. The angles between intermediate legs 34 and 36 and the respective upper and lower legs 26, 28 and 30, 32 are approximately one hundred degrees. The forward ends 38, 40 and 42, 44, respectively, are bent inwardly at angles of ninety degrees.

Figure 4:
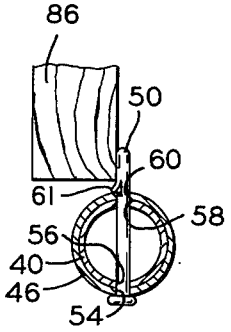
FIG. 4 is a sectional view taken along line 4—4 of FIG. 3 and viewed in the direction of the arrows.
Figure 3:
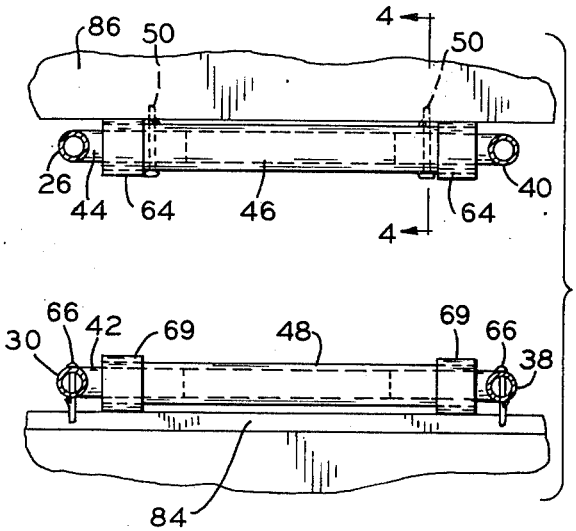
FIG. 3 is a vertically shortened sectional view taken along line 3—3 of FIG. 2 and viewed in the direction of the arrows.

Members 22 and 24 are connected together by means of upper connecting leg 46, which is telescopically received within the forward ends 44 and 40 of upper legs 26 and 28, and lower connecting leg 48, which is telescopically received within the forward ends 42 and 38 of lower legs 30 and 32 (FIG. 3). Plastic pins 50 extend through clearance holes 54, 56, 58 and 60 in upper connecting leg 46 and the forward ends 44 and 40 of upper legs 26 and 28, and are locked thereto by resilient locking ears 61, as shown in FIG. 4. Pins 50 are made of a material designed so as to prevent marring of the surface with which they come into contact. Flexible rubber sleeves 64 are disposed around connecting leg 46 and the forward ends 44 and 40 of upper legs 26 and 28 for the identical purpose and to cover the exposed ends of connecting leg 46. Due to the rigidity of the structure, lower connecting leg 48 need not be provided with connecting pins, such as pins 50.

Pins 66, similarly to pins 50, extend through clearance holes in lower legs 32 just behind the bent portions 38 and 42. By way of example, pins 66 are spaced rearwardly from the forward edges 67 of lower legs 30 and 32 by a distance of two inches. Rubber sleeves 69 around leg 48 prevent marring of the surfaces with which they come into contact, and also cover the exposed ends of leg 48 where it joins forward ends 38 and 42 of lower legs 30 and 32.

In the frame structure described above, the corresponding legs of tubular members 22 and 24 are parallel, as are upper and lower connecting legs 46 and 48. The distance in the horizontal direction between the plane of intermediate legs 36 and the plane of the forward edges 67 of members 22 and 24 is approximately twelve inches, and the distance between upper and lower connecting legs 46 and 48 is approximately nineteen inches. The width of the fan unit 12 as between legs 26 and 28, for example, is approximately twenty inches, and blade guard 16 is approximately nineteen inches in diameter. Pins 50 and 66 protrude approximately one inch and three quarters of an inch, respectively, beyond the respective portions of the frame to which they are connected. It should be noted that the above dimensions are merely exemplary of one possible size of fan, and do not in any way limit the invention.

Figure 5:
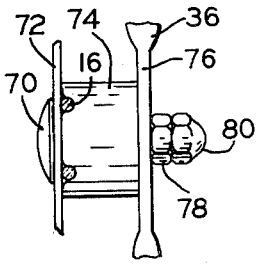
FIG. 5 is an enlarged detail of one of the pivotal connections between the fan guard and frame.

With particular reference to FIG. 5, blade guard 16 is pivotally connected to frame 14 by means of bolts 70, which pass through plates on the inside of guard 16, rubber grommet 74, which is on the other side of guards 16, and a flattened portion 76 of intermediate legs 34 and 36. Nuts 78 and cap nuts 80 serve to lock the assembly together. The fractional contact between grommets 74 and flattened portions 76 serve to fractionally hold the guard 16 against rotation relative to frame 14 unless force sufficient to overcome the frictional forces is exerted. This enables the fan to be oriented in any desired direction about the axis extending between bolts 70. FIGS. 1 through 4 show the fan unit 12 mounted within a standard vertical sash-type window comprising window frame 82, which includes sill 84, and a vertically slidable window 86, which together define window opening 88. In FIG. 1, the fan unit 12 is shown mounted in the air intake mode, and in FIG. 2 it is mounted in the exhaust mode wherein guard 16 is rotated one hundred and eighty degrees about the axis defined by pivot bolts 70. Obviously, any other orientation through a vertical plane is possible simply by adjusting the position of guard 16.

The fan unit 12 is mounted in the window opening 88 by resting lower sleeves 69 on sill 84, raising window 86 until pins 50 can be passed thereunder, and then lowering window 86 slightly behind pins 50. When fan unit 12 is released, the weight of the blades 18, motor 20 and the rear portion of frame 14 will produce a cantilever effect tending to rotate the unit 12 in a clockwise direction as viewed in FIG. 2. This will pull upper pins 50 inwardly against window 86 and push lower pins 66 outwardly against sill 84. It will be noted that a substantial portion of lower legs 30 and 32 extend within the opening beyond lower pins 66, and, due to the fact that tubular members 22 and 24 diverge in the forward direction, frame 14 will be, in effect, wedged into the opening 88 defined by window 86, frame 82 and sill 84. Should the unit be accidentally pulled inwardly, as by a small child, the frame 14, because it is wedge-shaped, will more likely resist this movement which could disengage it from the window opening. Although it is preferred that both the upper legs 26 and 28 and the lower legs 30 and 32 of members 22 and 24 be angled with respect to the horizontal direction, the wedging effect described above can be achieved to some degree even if only the lower legs 30 and 32 are so angled.

Figure 2:
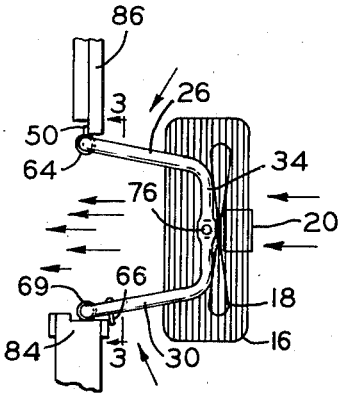
FIG. 2 is a side elevational view of the window-mounted fan shown in FIG. 1.

It will be noted that the fan unit 12 can be mounted in a window of this type without the necessity for any additional hardware, and without the necessity for removing the window screen, if one is installed outside the window. Furthermore, the fan blades 18 are spaced inwardly from the window opening 88 by a frame which is substantially open thereby permitting air to flow not only from the rear through blade guard 16, but also laterally into the airstream in front of guard 16 as illustrated by the arrows in FIG. 2. This is in accordance with the principle that the pressure within a stream of moving air is lower than that of the surrounding air so that the surrounding air will be pulled into the main stream. The effect produced by this arrangement is a substantial increase in the volume of air moved by the fan per unit time, when the fan is mounted in the exhaust mode as shown in FIG. 2.

To remove the fan unit 12, it is merely necessary to raise window 86 until it clears pins 50, and then swing the unit inwardly.

Figure 6:
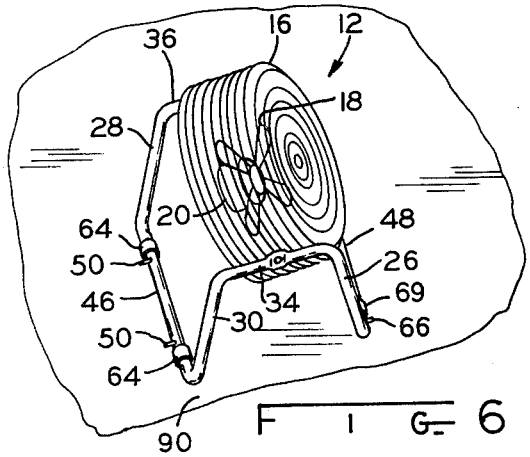
FIG. 6 is a perspective view showing the fan unit being used as a floor fan.
Figure 7:
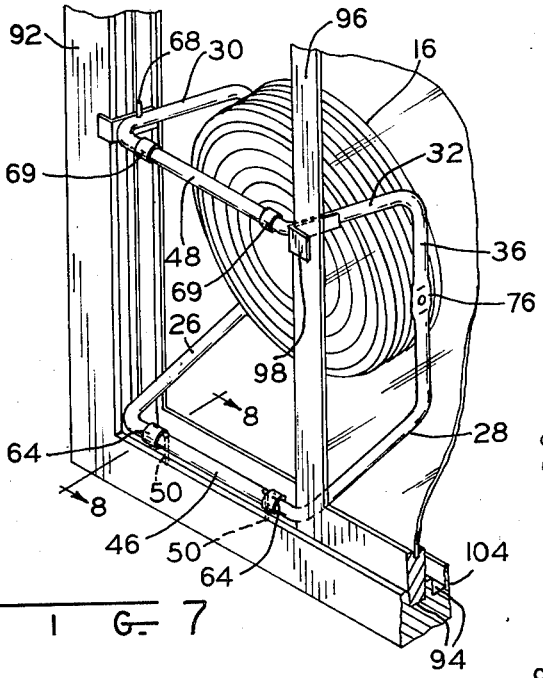
FIG. 7 is a perspective view looking in from the outside of a sliding window showing the fan unit according to the present invention mounted therein.
Figure 9:
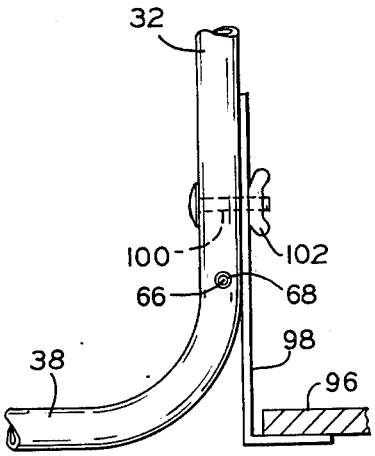
FIG. 9 is an enlarged detail of one of the support brackets shown in FIG. 7.
Figure 8:
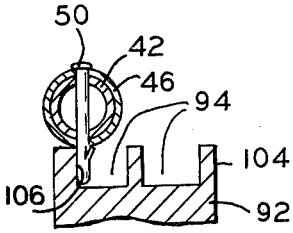
FIG. 8 is a sectional view taken along line 8—8 of FIG. 7 and viewed in the direction of the arrows.

FIG. 6 illustrates how the fan unit 12 can be used as a floor fan. In this case, the unit 12 is supported on all four of the rubber sleeves 64 and 69. The frame is dimensioned such that guard 16 may be rotated to any position about the axis defined by bolts 70. FIGS. 7 through 10 illustrate the fan unit 12 mounted in a sliding window comprising frame 92 having horizontal tracks 94 in which window 96 is received for horizontal sliding movement. In this case, a pair of L-shaped brackets 98 are adjustably secured to lower legs 30 and 32 by means of bolts 100 extending through legs 30 and 32 and secured thereto by wing nuts 102. With frame 14 inverted from the position shown in FIG. 1, window 96 is opened, pins 50 are inserted in one of the tracks 94 of frame 92, or, alternatively, against the inner surface 104 of frame 92, the unit 12 is rotated outwardly such that brackets 98 are disposed beyond frame 92 and window 96, unit 12 is slid to the left (as viewed in FIG. 7) until the left bracket 98 extends laterally beyond frame 92, and then window 96 is closed to the point where it is disposed behind the right bracket 98. When the fan unit 12 is released, the cantilever effect produced by the mass of the unit spaced inwardly from the window opening will cause brackets 98 to be pulled inwardly against frame 92 and window 96, and will cause pins 50 to be pushed outwardly against the wall 106 of the track 94 in which they are disposed, or alternatively against the inner surface 104 of frame 92.

Figure 10:
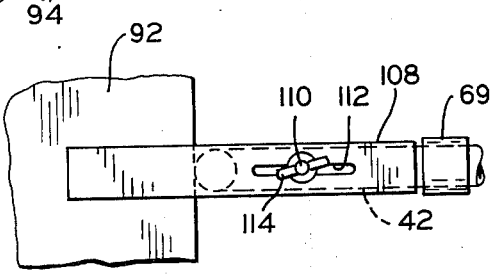
FIG. 10 is a front elevational view of a modified bracket arrangement.

An alternative embodiment is illustrated in FIG. 10 wherein L-shaped brackets 98 may be replaced by essentially straight brackets 108, which are adjustably connected to the forward ends 38 and 42 of members 22 and 24 by bolts 110 which extend through portions 38 and 40 of members 22 and 24 and elongated slots 112 or holes in brackets 108. Wing nuts 114 or other fasteners serve to tighten the assembly. In this case, one bracket 108 will extend laterally beyond window frame 92, and the other beyond the sliding window 96. Brackets 98 and 108 need not be adjustably mounted to frame 14, although this may be desirable in some cases.

Although the construction for the fan unit as described above is a preferred embodiment of the invention, many alternative constructions are possible. For example, pins 50 and 66 could be replaced by a plate or flat protrusions with greater surface area welded, bolted, or otherwise secured in place. Also, rubber sleeved bolts could be threadedly secured to the frame. Furthermore, rubber sleeves 64 and 69 may be replaced by rigid plastic sleeves which are secured by means of set screws.

Alternatively, frame 14 could be made of one-piece construction with a single seam, or of two-piece construction with two seams. Rather than four rubber sleeves such as sleeves 64, a tripod supporting arrangement could be employed whereby only three sleeves would be necessary. This may result in a more stable unit when it is supported on the floor. In some cases, sliding window installations may require only a single bracket, such as bracket 98.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the part to which this invention pertains and fall within the limits of the appended claims.

What is claimed is:

1. A portable fan unit comprising:

a frame having a front portion and a rear portion separated by side means connected to and extending between said front and rear portions, motor driven fan means for producing a stream of moving air, said motor driven fan means being mounted to said frame and spaced rearwardly of said front portion, said side means being constructed so as to permit air flow therethrough into said stream of air in directions transverse to said stream of air, and means on said front portion adapted for suspending said frame from means defining a window opening such that said motor driven fan means is spaced from the means defining a window opening whereby air may be drawn into the air stream through said side means, said means for suspending comprising means on said frame front portion adapted for extending into the window opening and hooking around the means defining a window opening.

2. The fan unit of claim 1 wherein two of said side means taper in a rearwardly direction in respective generally vertical planes.

3. The fan unit of claim 1 wherein said frame is open and comprises a plurality of interconnected legs, said side means each comprise an upper side leg and a lower side leg which diverge relative to each other in the forward direction and in respective generally vertical planes.

4. The fan unit of claim 3 wherein said frame front portion includes upper and lower cross members connecting said upper side legs and said lower side legs, respectively, and wherein said means for hooking around a means defining a window opening comprises a protrusion on said upper cross member protruding above said upper cross member.

5. The fan unit of claim 4 wherein said means for suspending comprises a plurality of upwardly and downwardly protruding pins connected to said upper and lower cross members, respectively.

6. The fan unit of claim 5 wherein said pins are snap locked to said cross members.

7. The fan unit of claim 1 wherein said frame front portion comprises an upper cross member and a lower cross member connecting said side means, and said means for suspending comprises at least two upwardly extending protrusions on said upper cross member and at least two downwardly extending protrusions on said lower cross member.

8. The fan unit of claim 7 wherein the respective major portions of said cross members comprise straight leg sections.

9. The fan unit of claim 1 wherein said means for suspending comprises an upwardly protruding element on said frame front portion and a downwardly protruding element on said frame front portion, each of said protruding elements extending outwardly from said frame sufficiently to engage a portion of a means defining a window opening.

10. The fan unit of claim 1 wherein said means for suspending comprises a laterally protruding element on said frame front portion and a downwardly protruding element on said frame front portion, each of said protruding elements extending outwardly from said frame sufficiently to engage a portion of a means defining a window opening.

11. A portable fan unit comprising:

an open frame having a front portion and a rear portion and comprising a generally straight upper section and a generally straight lower section connected together by an intermediate section of said frame, said upper and lower sections lying in respective planes, said lower section plane intersecting said upper section plane at an acute angle, motor driven fan means pivotally connected to the intermediate section of said frame for rotation relative to said frame along an axis parallel to the planes of said upper and lower sections, and means on said front portion adapted, in use, for suspending said frame from means defining a window opening such that said motor driven fan means is spaced from the means defining a window opening, said means for suspending comprises means on said frame front portion adapted for extending into the window opening and hooking around means defining a window opening.

12. The fan unit of claim 11 wherein said means for suspending comprises an upwardly protruding element on said upper section and a downwardly protruding element on said lower section, said elements protruding beyond said frame.

13. The fan unit of claim 11 wherein said means for suspending comprises an element on said upper section which protrudes laterally beyond said frame, and an element on said lower section which protrudes downwardly beyond said frame.

14. A combination window and floor fan unit comprising:

a frame having a base and at least two side members extending from said base, a motor and fan driven thereby pivotally mounted between said side members for rotation about an axis extending between said side members and generally parallel to said base, said motor driven fan being spaced from said base sufficiently to enable at least one hundred and eighty degree rotation of said motor and fan without coming into contact with said base, said base being adapted for stable support on a planar surface such as a floor or the like, and means on said front portion adapted, in use, for suspending said frame from means defining a window opening such that said fan is spaced from the means defining a window opening, said means for suspending comprising means on said base adapted for extending into the window opening and hooking around the means defining a window opening.

15. The fan unit of claim 14 wherein said frame comprises a plurality of interconnected tubular legs.

16. The fan unit of claim 15 wherein said frame is generally U-shaped and comprises a first leg, a second leg, and a third leg connecting said first and second legs, said motor and fan being pivotally connected to said third leg.

17. The fan unit of claim 16 wherein said means for hooking comprises an element on said first leg protruding outwardly from said frame in a direction generally parallel to said base.

18. The fan unit of claim 17 wherein said element comprises a pin.

19. The fan unit of claim 16 wherein said first and second legs diverge from said third leg, and said means for suspending comprises elements on said first and second legs protruding therefrom in mutually opposite directions.

20. In combination with a window opening bounded by a window and window frame, the window opening having an inside and an outside, a fan unit comprising: an open frame having a front portion and a rear portion, said front and rear portions being connected by side portions, a motor driven fan connected to said frame rear portion, first protruding means on said frame front portion engaging said window frame on the outside of the window opening, and second means generally below said first protruding means for engaging said window frame on the inside of the window opening, said motor driven fan being suspended inwardly away from said window opening by said open frame, said first protruding means and said second means being urged into engagement with said window and window frame, respectively, by a cantilever effect produced by the suspension of said fan away from said window opening which pulls said first protruding means inwardly against said window and pushes said second means outwardly against said window frame.

21. The combination of claim 20 wherein said motor driven fan is pivotally connected to said frame for rotation about an axis generally perpendicular to the axis of rotation of said fan.

22. The combination of claim 20 wherein said second means protrudes downwardly from said frame front portion.

23. The combination of claim 20 wherein said second means protrudes downwardly from said fan unit frame front portion and is spaced rearwardly from a front edge of said fan unit frame by at least one inch.

24. The combination of claim 20 wherein at least two of said side portions diverge in a forward direction and in respective vertical planes, and said second means protrudes downwardly from said fan unit frame front portion and is spaced rearwardly from a lower front edge of said fan unit frame front portion so that a substantial lower portion of said fan unit frame extends beyond said window frame and into said opening, said diverging side portions and the lower portion of said fan unit frame extending into said opening serving to wedge said fan unit frame in said opening.

25. In combination with means defining a window opening having an inside and an outside on respective opposite sides of the opening, a fan unit comprising: a frame having a front portion and a rear portion spaced rearwardly from said front portion, a motor driven fan connected to said rear portion, first protruding means on said frame front portion extending outwardly from said frame and engaging said means defining a window opening on one of the inside or outside thereof, and second means on said frame front portion generally below said first means engaging the means defining a window opening on the other of the inside or outside thereof, said motor driven fan being suspended one of inwardly or outwardly away from said window opening by said frame, said first and second means being urged into abutting engagement with said means defining a window opening by the cantilever effect produced by the suspension of said motor driven fan spaced away from the window opening which pulls said first means against the means defining a window opening and pushes said second means against the means defining a window opening.

26. The combination of claim 25 wherein said motor driven fan is pivotally connected to said frame.

27. The combination of claim 25 wherein said second means protrudes outwardly from said frame.

28. The combination of claim 25 wherein said first means comprises at least one element protruding upwardly from said frame, and said second means comprises at least one element protruding downwardly from said frame.

29. The combination of claim 25 wherein said first means comprises at least two elements protruding laterally from said frame, and said second means comprises at least one element protruding downwardly from said frame.

30. A portable fan unit comprising:

a frame having a front portion and a rear portion separated by side means connected to and extending between said front and rear portions, motor driven fan means for producing a stream of moving air, said motor driven fan means being mounted to said frame and spaced rearwardly of said frame front portion, said side means being constructed so as to permit air flow therethrough into said stream of air in directions transverse to said stream of air, and means on said front portion adapted for suspending said frame from means defining a window opening such that said motor driven fan means is spaced from the means defining a window opening whereby air may be drawn into the stream of air through said side means, said means for suspending comprising first protruding means on said frame front portion adapted for engaging one side of the means defining a window opening and second protruding means on said frame front portion adapted for engaging the means defining a window opening on the other side of the window opening, whereby when the fan is suspended inwardly of the means defining a window opening by said frame, said first protruding means will be pulled inwardly and said second protruding means will be pushed outwardly against the means defining a window opening by the cantilever effect produced by the suspension of the fan away from the window opening.

31. The combination of claim 30 wherein said window is a horizontally sliding window slidably received in a window frame having a lower horizontal groove, and said second protruding means is received in said groove.

32. The combination of claim 30 wherein said window is a vertical sash-type window, said window frame includes a sill, and said second protruding means abuts said sill.

* * * * *